US012727677B2

(12) United States Patent
Zeng

(10) Patent No.: US 12,727,677 B2
(45) Date of Patent: Sep. 8, 2026

(54) MANUALLY ADJUSTABLE BED

(71) Applicants: Huizhou Flex Smart Furniture Co., Ltd., Huizhou (CN); Depeng Zeng, Huizhou (CN); Wenhao Zeng, Huizhou (CN)

(72) Inventor: Guohong Zeng, Huizhou (CN)

(73) Assignees: Huizhou Flex Smart Furniture Co., Ltd., Huizhou (CN); Depeng Zeng, Huizhou (CN); Wenhao Zeng, Huizhou (CN)

( * ) Notice: Subject to any disclaimer, the term of this patent is extended or adjusted under 35 U.S.C. 154(b) by 0 days.

(21) Appl. No.: 18/898,935

(22) Filed: Sep. 27, 2024

(65) Prior Publication Data

US 2025/0057321 A1 Feb. 20, 2025

(30) Foreign Application Priority Data

Jul. 5, 2024 (CN) ..... 202421585743.5

(51) Int. Cl.
*A47C 20/04* (2006.01)

(52) U.S. Cl.
CPC ..... *A47C 20/043* (2013.01)

(58) Field of Classification Search
CPC ..... A47C 20/04; A47C 20/043; A61G 7/002; A61G 13/08; A61G 7/015
USPC ..... 5/613, 618
See application file for complete search history.

(56) References Cited

U.S. PATENT DOCUMENTS 392,009 A * 10/1888 Cleaveland ..... A61G 7/015 267/98
514,403 A * 2/1894 Allen ..... B60N 2/22 297/354.12
1,036,026 A * 8/1912 Temple ..... G05G 5/18 74/533

(Continued)

FOREIGN PATENT DOCUMENTS

CH 692268 A5 * 4/2002 ..... A47C 20/043
DE 19602200 A1 * 7/1997 ..... A47C 20/043

(Continued)

OTHER PUBLICATIONS

Translation CH-692268-A5 (Year: 2025).*

(Continued)

*Primary Examiner* — J. T. Newton
(74) *Attorney, Agent, or Firm* — Hemisphere Law, PLLC

(57) ABSTRACT

The present disclosure provides a manually adjustable bed, including: a bed frame, wherein a fixed bed board is fixedly mounted at an upper part of the bed frame; a movable bed board is hinged to each of two ends of the fixed bed board; a cross rod is fixedly mounted on each movable bed board; a group of angle adjustment mechanism is mounted between each cross rod and the bed frame; the angle adjustment mechanisms are configured to adjust inclination angles of the movable bed boards to meet usage needs of different users; each group of angle adjustment mechanism includes two fixed frames, two middle baffle plates, a positioning rod, and a connecting rod. The manually adjustable bed provided by the present disclosure has a novel and interesting operation mode, which can greatly improve the operation experience.

7 Claims, 8 Drawing Sheets

(56) References Cited

U.S. PATENT DOCUMENTS 1,902,249 A * 3/1933 Lanzy ..... A47C 20/045 5/617
2,250,026 A * 7/1941 Laukhuff ..... A47C 20/027 5/634
2,666,216 A * 1/1954 Schnaitter ..... A47C 20/043 5/660
2,968,050 A * 1/1961 Shankman ..... A47C 20/08 5/618
3,276,817 A * 10/1966 Marple ..... A47C 1/146 297/283.1
3,636,573 A * 1/1972 Bartz ..... A61G 7/015 5/660
4,281,424 A * 8/1981 Singer ..... A47C 19/022 5/310
4,660,237 A * 4/1987 Brodnax ..... A47C 20/043 5/636
5,519,902 A * 5/1996 Meade ..... A47C 20/04 5/47
5,588,766 A * 12/1996 Lai ..... F16B 7/105 403/107
5,706,536 A * 1/1998 Krauska ..... A47C 20/045 5/618
5,916,086 A * 6/1999 Rossdeutscher ..... A47C 31/123 5/613
6,151,730 A * 11/2000 Weston ..... A47C 20/043 5/112
7,025,421 B1 * 4/2006 Fowler ..... A47C 3/36 297/325
7,275,273 B2 * 10/2007 Lary ..... A47C 20/021 5/648
9,009,896 B2 * 4/2015 Suh ..... A47C 19/122 5/618
11,737,567 B2 * 8/2023 Luo ..... A47C 7/14 297/284.4
2016/0095772 A1 4/2016 Cole
2021/0368993 A1 12/2021 Wang et al.
2023/0038189 A1 * 2/2023 Sultan ..... A47C 20/027
2023/0404275 A1 * 12/2023 Wang ..... A47C 20/041
2025/0057321 A1 * 2/2025 Zeng ..... A47C 20/043

FOREIGN PATENT DOCUMENTS

DE 102007029519 A1 * 12/2008 ..... A47C 20/043
DE 102015106048 A1 * 10/2016 ..... A47C 20/043
EP 0532474 A1 * 3/1993 ..... A47C 17/162
EP 0561749 A1 * 9/1993 ..... A47C 7/5064
FR 1291179 A * 4/1962 ..... A47C 17/16
FR 1449401 A * 8/1966 ..... A47C 20/043

OTHER PUBLICATIONS

Translation DE-102007029519-A1 (Year: 2025).*
Translation DE-102015106048-A1 (Year: 2025).*
Translation DE-19602200-A1 (Year: 2025).*
Translation EP-0532474-A1 (Year: 2025).*
Translation EP-0561749-A1 (Year: 2025).*
Translation FR-1291179-A (Year: 2025).*
Translation FR-1449401-A (Year: 2025).*

* cited by examiner

MANUALLY ADJUSTABLE BED

TECHNICAL FIELD

The present disclosure relates to the technical field of adjustable beds, and in particular to, a manually adjustable bed.

BACKGROUND

An adjustable bed is generally adjustable in height or an angle of a bed board, which can meet the needs of different users. Main adjustment methods include electric adjustment, hydraulic adjustment, or manual adjustment. In the scheme for manually adjusting the angle of the bed board, the angle is usually adjusted in a hand-operated manner by using a screw rod for driving or by cooperation between a clamping slot and a clamping block. Although all these methods can meet the usage need for adjusting the angle of the bed board, the above operation methods are too ordinary and boring, resulting in a poor operating experience. Therefore, a manually adjustable bed is proposed.

SUMMARY

The present disclosure aims to solve the problems in the background section, and provides a manually adjustable bed.

Specific technical solutions are as follows:

A manually adjustable bed includes:

a bed frame, wherein a fixed bed board is fixedly mounted at an upper part of the bed frame; a movable bed board is hinged to each of two ends of the fixed bed board; a cross rod is fixedly mounted on each movable bed board; and a group of angle adjustment mechanism is mounted between each cross rod and the bed frame.

As a preferred solution of the present disclosure, each group of angle adjustment mechanism includes two fixed frames, two middle baffle plates, a positioning rod, and a connecting rod; the two fixed frames are symmetrically and fixedly mounted on two sides of the bed frame; several angle adjustment clamping slots are provided at bottoms of inner frames of the two fixed frames; the two middle baffle plates are symmetrically and fixedly mounted on the two sides of the bed frame; the middle baffle plate on the same side is located in the inner frame of the fixed frame on the same side; gaps are reserved between two ends of the middle baffle plate on the same side and the inner frame of the fixed frame on the same side; elastically telescopic pins are mounted at two ends of the positioning rod; the elastically telescopic pins are clamped into the angle adjustment clamping slots at the corresponding positions; the elastically telescopic pins pass through the gaps; one end of the connecting rod is fixedly connected to the positioning rod; and the other end of the connecting rod is hinged to the cross rod.

As a preferred solution of the present disclosure, each elastically telescopic pin includes a sealing cap, a resisting seat, a reset spring, and a cylindrical pin; the scaling cap is fixedly mounted at an end portion of the positioning rod; a guide hole is centrally formed in the sealing cap; the resisting seat is fixedly mounted in the end portion of the positioning rod; the reset spring resists between the resisting seat and the cylindrical pin; the reset spring is located in the end portion of the positioning rod; one end of the cylindrical pin extends out of the sealing cap through the guide hole under the action of the reset spring; and the cylindrical pin can be clamped into the adjustment clamping slot.

As a preferred solution of the present disclosure, guide blocks are fixedly mounted on two sides of the upper part of the bed frame and on outer sides of the fixed frames; and when ends of the cylindrical pins extending out of the sealing caps resist against the guide blocks, the cylindrical pins can fully retract into the guide holes.

As a preferred solution of the present disclosure, each group of angle adjustment mechanism includes two connecting rods; the two connecting rods are symmetrically arranged between the cross rod and the positioning rod.

As a preferred solution of the present disclosure, supporting legs are fixedly mounted at a bottom of the bed frame.

As a preferred solution of the present disclosure, bottom ends of the supporting legs are all sleeved with plastic sheaths.

As a preferred solution of the present disclosure, steel wire meshes are fixedly mounted at an upper part of the fixed bed board and upper parts of the movable bed boards.

As a preferred solution of the present disclosure, a handle is fixedly mounted at an upper part of one end of each of the movable bed boards away from the fixed bed board.

As a preferred solution of the present disclosure, a pulling-assisted assembly is arranged between the positioning rod and an end portion of the bed frame; the pulling-assisted assembly includes a first spring seat, a second spring seat, and a pull spring; the first spring seat is fixedly mounted at the end portion of the bed frame; the second spring seat is fixedly mounted on the positioning rod; and the pull spring is mounted on the second spring seat and the first spring seat.

The present disclosure has the following beneficial effects:

According to the manually adjustable bed provided in the present disclosure, when the movable bed boards continue to be lifted after being lifted to the highest positions, the cylindrical pins can enter a space between the upper parts of the middle baffle plates and the tops of the inner frames of the fixed frames through the gaps close to the middle of the bed frame, and the movable bed boards are then released. Under the action of the gravity of the movable bed boards, the cylindrical pins slide towards the gaps away from the middle of the bed frame until the cylindrical pins fall into a space between the bottoms of the middle baffle plates and the bottoms of the inner frames of the fixed frames through the gaps. At this time, the movable bed boards are in a horizontal state, and the movable bed boards are lifted to clamp the cylindrical pins into the angle adjustment slots to adjust the inclination angles of the movable bed boards again. In the entire process of adjusting the inclination angles until the movable bed boards are in the horizontal state, the cylindrical pins move counterclockwise along a trajectory of peripheral edges of the middle baffle plates all the time. The operation method is new and interesting, and the operation experience can be greatly enhanced.

Figure 1:
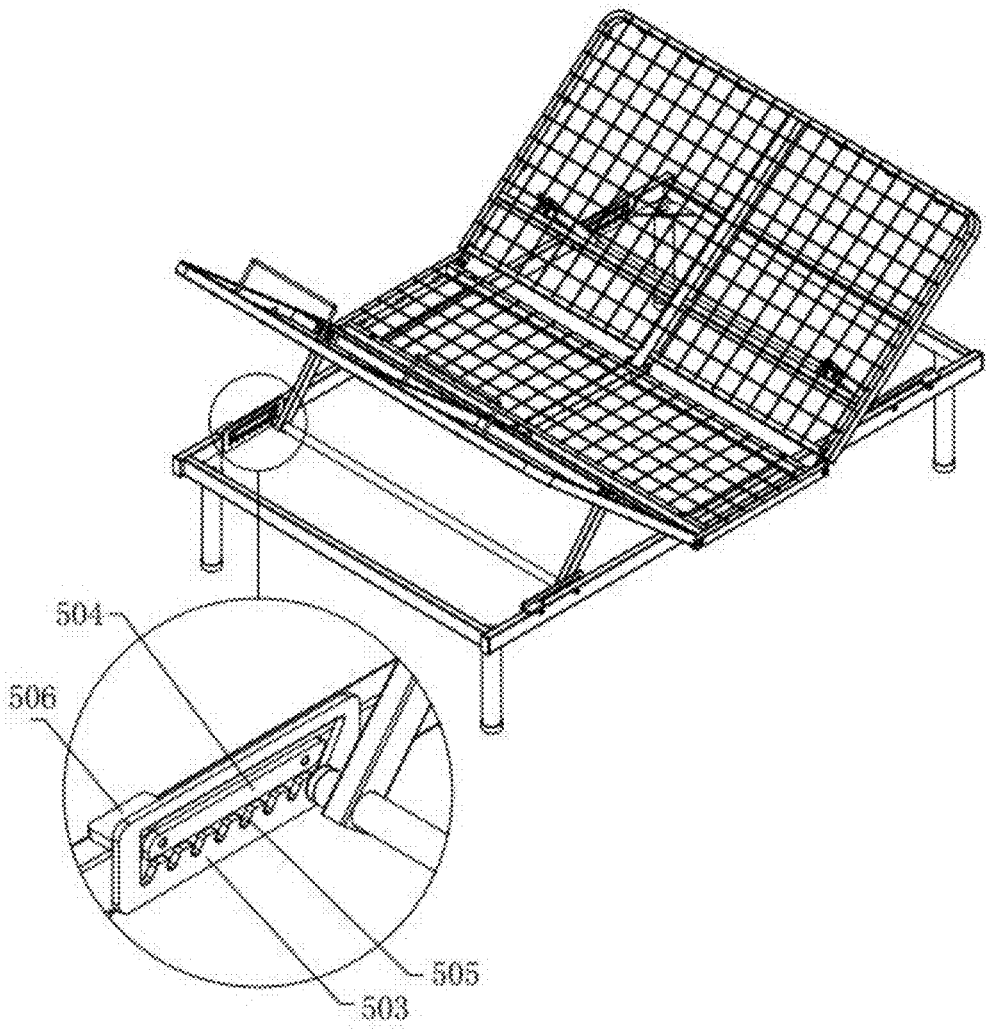
FIG. 1 is a schematic structural diagram I of a manually adjustable bed according to an embodiment of the present disclosure.

1: bed frame;

2: fixed bed board;

3: movable bed board; 301: cross rod; 302: handle;

4: supporting leg;

5: angle adjustment mechanism; 501: positioning rod; 502: connecting rod; 503: fixed frame; 504: middle baffle plate; 505: angle adjustment clamping slot; 506: guide block; 507: elastic telescopic pin; 5071: sealing cap; 5072: cylindrical pin; 5073: reset spring; 5074: resisting seat; 5075: guide hole;

6: pulling-assisted assembly; 601: first spring seat; 602: second spring seat; and 603: pull spring.

DETAILED DESCRIPTION OF THE EMBODIMENTS

The technical solutions of the present disclosure will be further explained below in conjunction with the accompanying drawings and specific implementations.

The accompanying drawings are only for illustrative purposes and represent only schematic diagrams, not physical diagrams. They cannot be understood as a limitation on this patent. To better explain the embodiments of the present disclosure, some components in the accompanying drawings may be omitted, enlarged, or reduced, which does not represent a size of an actual product. For those skilled in the art, it can be understood that some well-known structures and their explanations in the accompanying drawings may be omitted.

The identical or similar numerals in the accompanying drawings in this embodiment correspond to identical or similar components. In the description of the present disclosure, it should be understood that orientations or positional relationships indicated by the terms "upper", "lower", "left", "right", "inner", "outer", and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms for describing the positional relationships in the accompanying drawings are only used for exemplary illustrations and are not construed as limiting the present disclosure. A person of ordinary skill in the art can understand the specific meanings of the above terms according to specific situations.

In the description of the present disclosure, unless otherwise expressly specified and limited, in case of a term "connection" that indicates connection relationships between components, the term should be understood in a broad sense, such as, a fixed connection, a detachable connection, an integrated connection, a mechanical connection, an electrical connection, a direct connection, an indirect connection through an intermediate medium, an internal communication of two components, or interaction between two components. For those of ordinary skill in the art, the specific meanings of the aforementioned terms in the present disclosure can be understood based on specific conditions.

Embodiment 1

Figure 2:
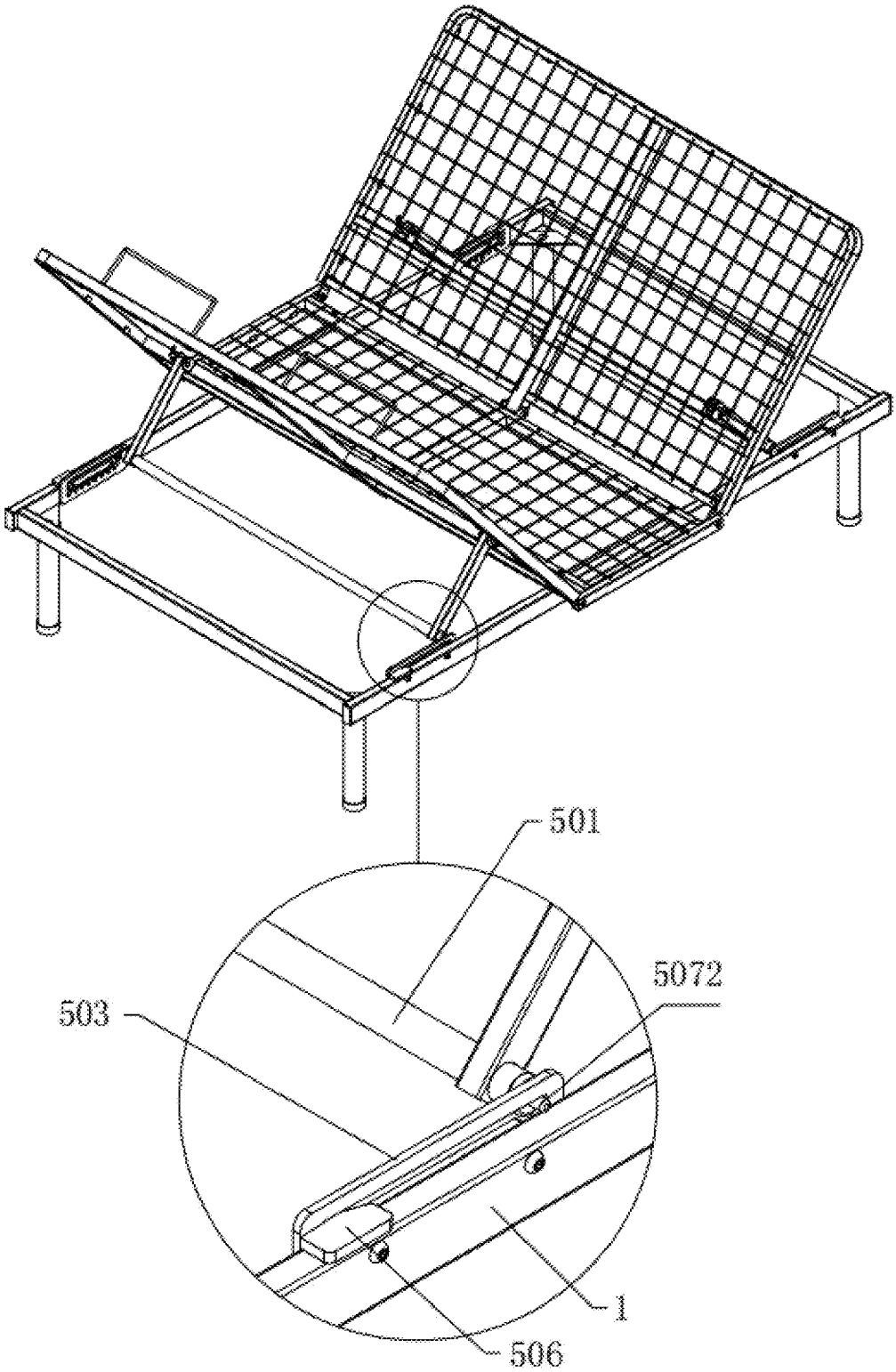
FIG. 2 is a schematic structural diagram II of a manually adjustable bed according to an embodiment of the present disclosure.
Figure 3:
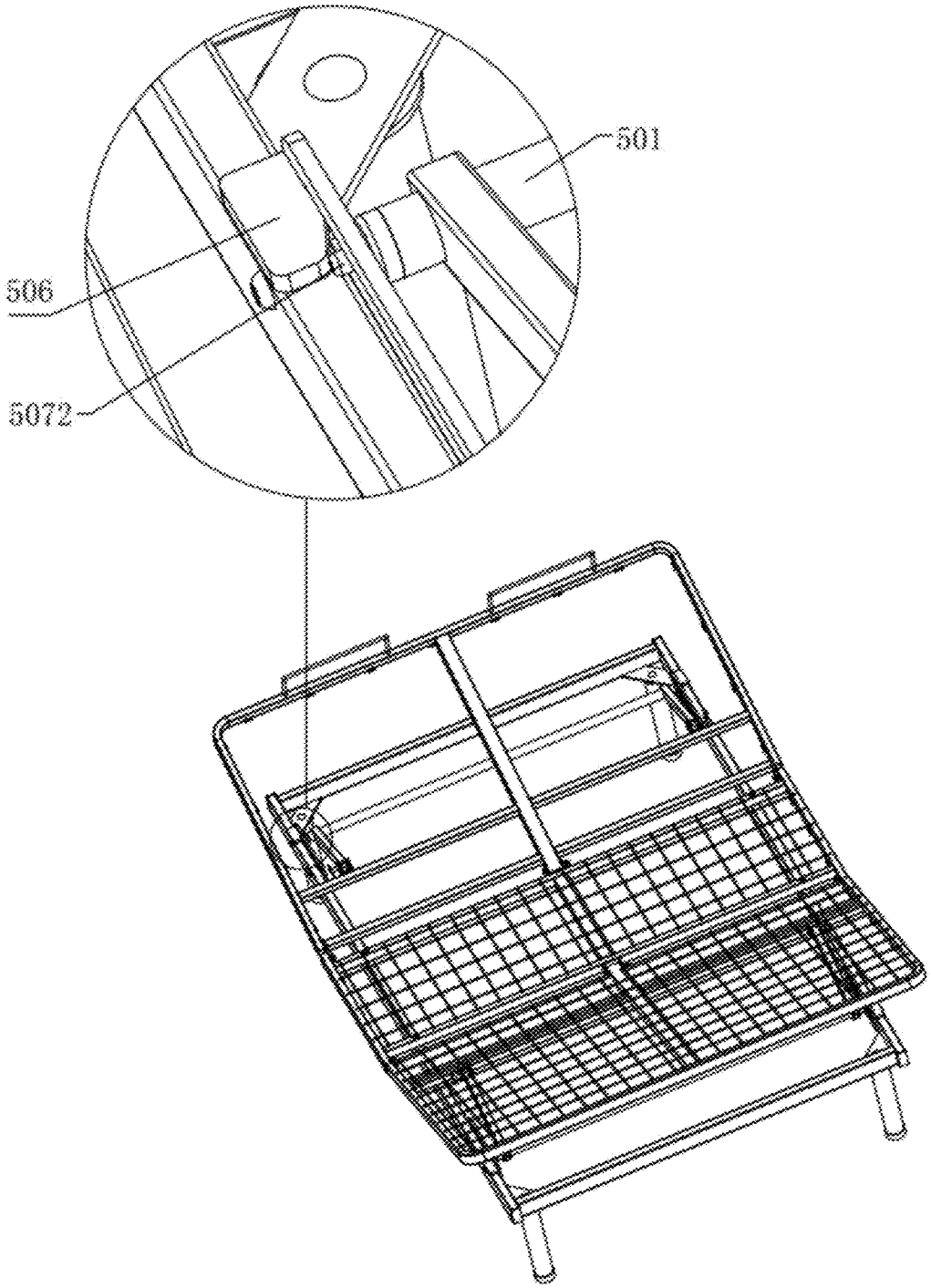
FIG. 3 is a schematic structural diagram III of a manually adjustable bed according to an embodiment of the present disclosure.
Figure 4:
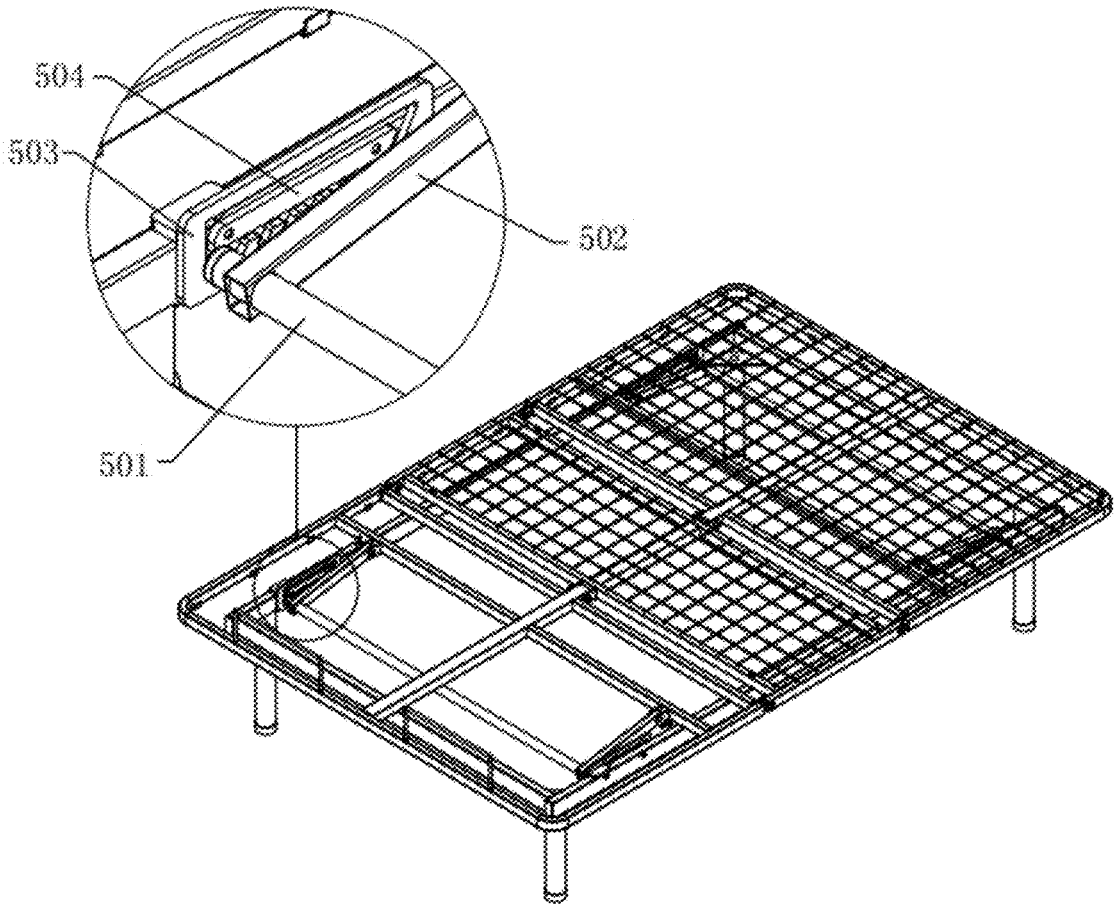
FIG. 4 is a schematic structural diagram IV of a manually adjustable bed according to an embodiment of the present disclosure.
Figure 5:
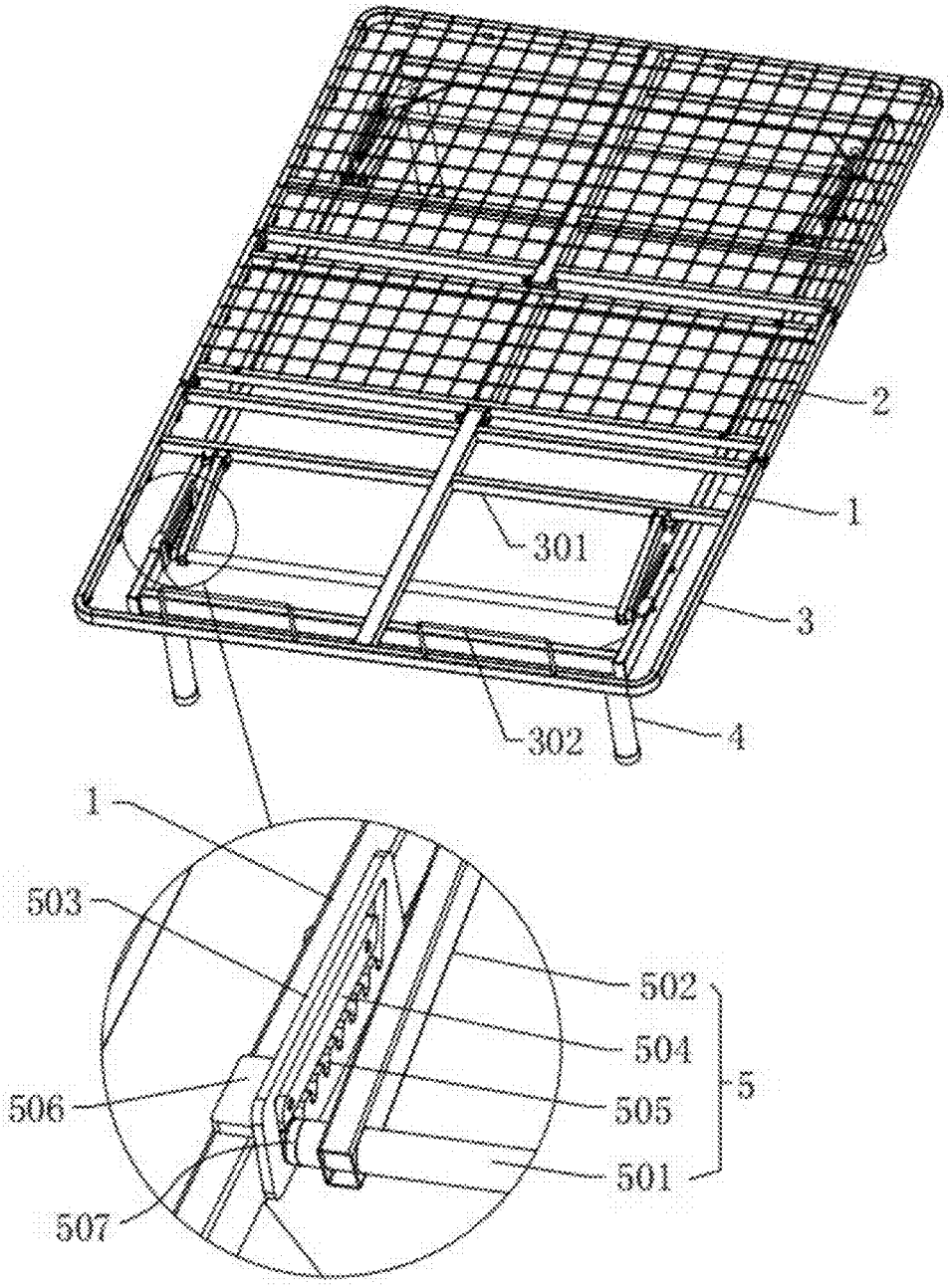
FIG. 5 is a schematic structural diagram V of a manually adjustable bed according to an embodiment of the present disclosure.
Figure 6:
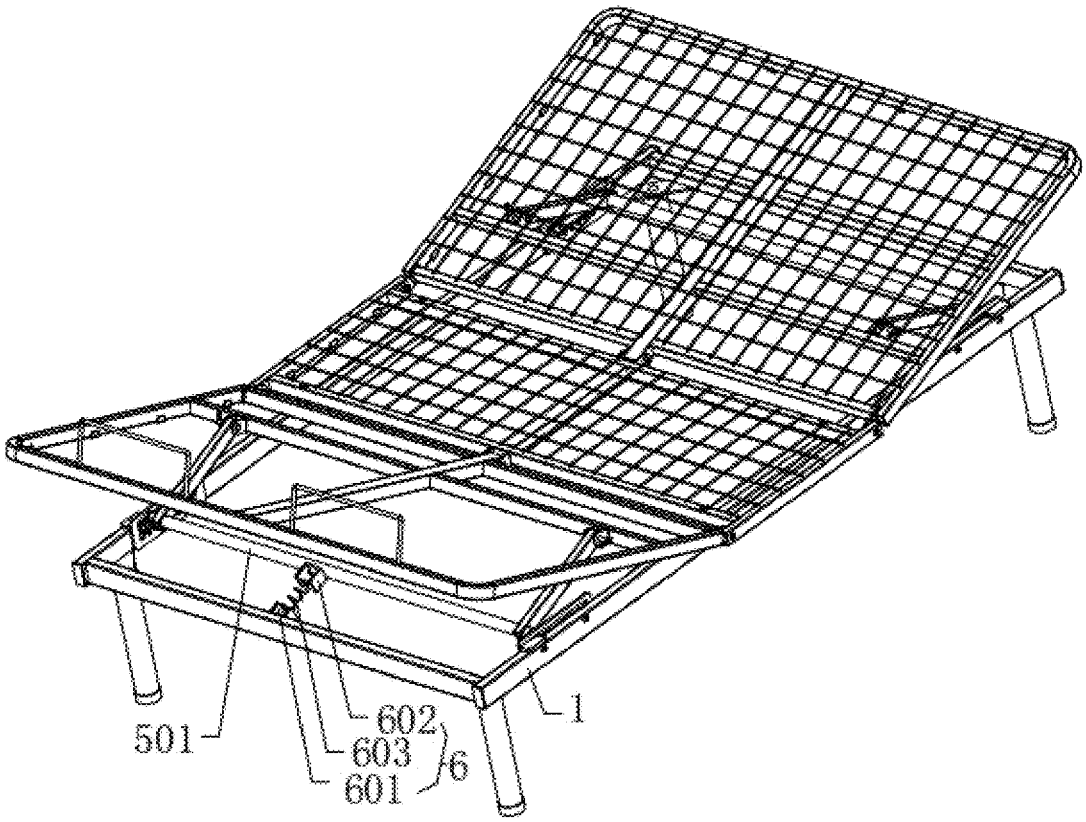
FIG. 6 is a schematic structural diagram VI of a manually adjustable bed according to an embodiment of the present disclosure.
Figure 7:
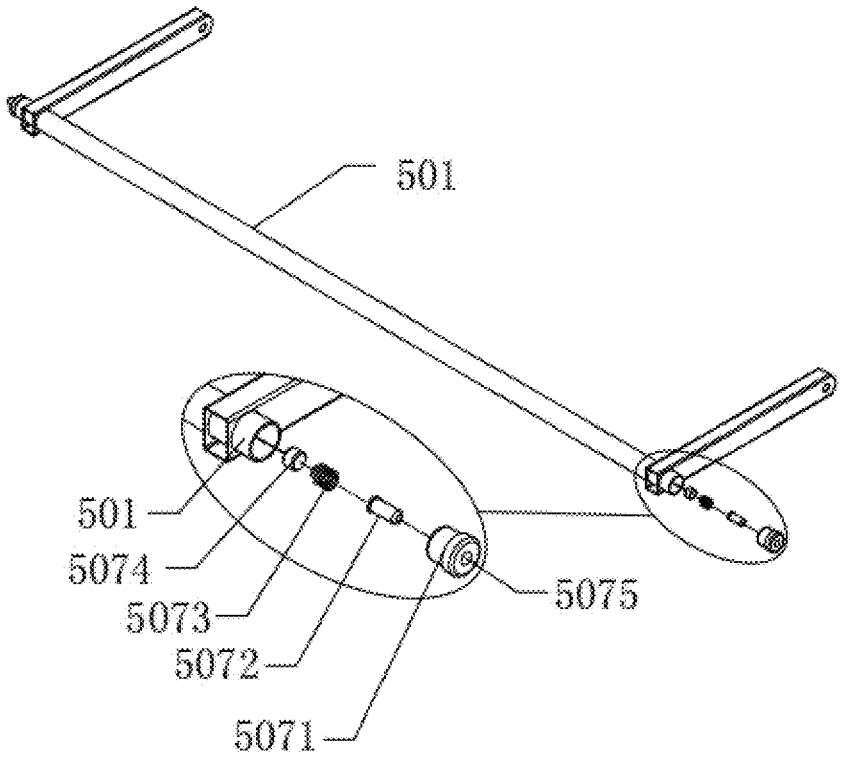
FIG. 7 is a partially structural exploded diagram of a manually adjustable bed according to an embodiment of the present disclosure.
Figure 8:
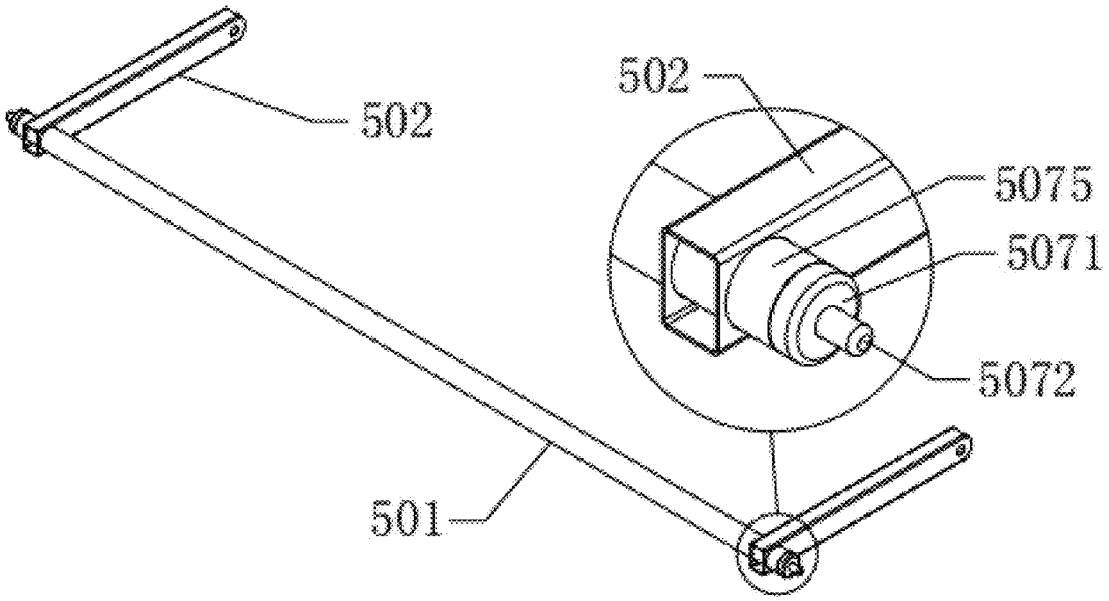
FIG. 8 is a partially structural diagram of a manually adjustable bed according to an embodiment of the present disclosure.

This embodiment provides a manually adjustable bed, as shown in FIG. 1 to FIG. 8, includes: a bed frame 1, wherein a fixed bed board 2 is fixedly mounted at an upper part of the bed frame 1; a movable bed board 3 is hinged to each of two ends of the fixed bed board 2; a cross rod 301 is fixedly mounted on each movable bed board 3; and a group of angle adjustment mechanism 5 is mounted between each cross rod 301 and the bed frame 1. The angle adjustment mechanism 5 is configured to adjust an inclination angle of the movable bed board 3 to meet usage of different users.

Specifically, in this embodiment, each group of angle adjustment mechanism 5 includes two fixed frames 503, two middle baffle plates 504, a positioning rod 501, and a connecting rod 502; the two fixed frames 503 are symmetrically and fixedly mounted on two sides of the bed frame 1; several angle adjustment clamping slots 505 are provided at bottoms of inner frames of the two fixed frames 503; the two middle baffle plates 504 are symmetrically and fixedly mounted on the two sides of the bed frame 1; the middle baffle plate 504 on the same side is located in the inner frame of the fixed frame 503 on the same side; gaps are reserved between two ends of the middle baffle plate 504 on the same side and the inner frame of the fixed frame 503 on the same side; elastically telescopic pins 507 are mounted at two ends of the positioning rod 501; the elastically telescopic pins 507 are clamped into the angle adjustment clamping slots 505 at the corresponding positions; the elastically telescopic pins 507 pass through the gaps; one end of the connecting rod 502 is fixedly connected to the positioning rod 501; and the other end of the connecting rod 502 is hinged to the cross rod 301.

Specifically, in this embodiment, each elastically telescopic pin 507 includes a sealing cap 5071, a resisting seat 5074, a reset spring 5073, and a cylindrical pin 5072; the sealing cap 5071 is fixedly mounted at an end portion of the positioning rod 501; a guide hole 5075 is centrally formed in the sealing cap 5071; the resisting seat 5074 is fixedly mounted in the end portion of the positioning rod 501; the reset spring 5073 resists between the resisting seat 5074 and the cylindrical pin 5072; the reset spring 5073 is located in the end portion of the positioning rod 501; one end of the cylindrical pin 5072 extends out of the sealing cap 5071 through the guide hole 5075 under the action of the reset spring 5073; and the cylindrical pin 5072 can be clamped into the adjustment clamping slot 505.

When the angle adjustment mechanisms 5 of the above solution are used, the movable bed boards 3 are lifted to clamp the cylindrical pins 5072 into the angle adjustment clamping slots 505, so that the cylindrical pins 5072 can be clamped into different angle adjustment clamping slots 505 according to a need. A difference between the angle adjustment mechanisms 5 designed in the present disclosure and an adjustment mechanism in the prior art is that:

When the movable bed boards 3 continue to be lifted after being lifted to the highest positions, the cylindrical pins 5072 can enter a space between the upper parts of the middle baffle plates 504 and the tops of the inner frames of the fixed frames 503 through the gaps close to the middle of the bed frame 1, and the movable bed boards 3 are then released. Under the action of the gravity of the movable bed boards 3, the cylindrical pins 5072 slide towards the gaps away from the middle of the bed frame 1 until the cylindrical pins fall into a space between the bottoms of the middle baffle plates 504 and the bottoms of the inner frames of the fixed frames 503 through the gaps. At this time, the movable bed boards 3 are in a horizontal state. The movable bed boards 3 are then lifted to clamp the cylindrical pins 5072 into the angle adjustment slots 505 to adjust the inclination angles of the movable bed boards 3 again. In the entire process of adjusting the inclination angles until the movable bed boards 3 are in the horizontal state, the cylindrical pins 5072 move counterclockwise along a trajectory of peripheral edges of the middle baffle plates 504 all the time. The operation method is new and interesting, and the operation experience can be greatly enhanced.

Specifically, in this embodiment, to enable the cylindrical pins 5072 to successfully enter the gaps of the middle baffle plates 504 away from the bed frame 1, guide blocks 506 are fixedly mounted on two sides of the upper part of the bed frame 1 and on outer sides of the fixed frames 503; and when ends of the cylindrical pins 5072 extending out of the sealing caps 5071 resist against the guide blocks 506, the cylindrical pins can fully retract into the guide holes 5075. Oblique guide incisions are provided on inner sides of ends of the guide blocks 506 facing the middle of the bed frame 1, so that the cylindrical pins 5072 can successfully retract into the guide holes 5075 through the guide action of the oblique guide incisions, and the cylindrical pins 5072 can successfully enter the gaps away from the middle of the bed frame 1, thereby successfully completing the angle adjustment operation on the movable bed boards 3.

Specifically, in this embodiment, to improve the structural stability of the angle adjustment mechanisms 5, each group of angle adjustment mechanism 5 includes two connecting rods 502; and the two connecting rods 502 are symmetrically arranged between the cross rod 301 and the positioning rod 501.

Specifically, in this embodiment, to facilitate stable placement of the bed frame 1, supporting legs 4 are fixedly mounted at a bottom of the bed frame 1. To improve the antiskid effect of the supporting legs 4, bottom ends of the supporting legs 4 are all sleeved with plastic sheaths.

Specifically, in this embodiment, to improve the comfortableness, steel wire meshes are fixedly mounted at an upper part of the fixed bed board 2 and upper parts of the movable bed boards 3.

Specifically, in this embodiment, to facilitate operating the movable bed boards 3, a handle 302 is fixedly mounted at an upper part of one end of each of the movable bed boards 3 away from the fixed bed board 2.

It is worth mentioning that the cylindrical pins 5072 are T-shaped, and ends of the cylindrical pins that are in contact with the reset springs 5073 are large, so that the impact on use caused by the fact that the cylindrical pins pop up completely from the guide holes 5075.

Meanwhile, when clamped into the angle adjustment clamping slots 505, the cylindrical pins 5072 resist against the inner side wall of the bed frame 1. In this way, the cylindrical pins 5072 can be prevented from shaking. Moreover, a user may feel it when the cylindrical pins are clamped into different angle adjustment clamping slots 505, which can greatly enhance the operation experience.

A difference between this embodiment and Embodiment 1 is that: To enable the movable bed boards 3 to be successfully reset and lie flatly, a pulling-assisted assembly 6 is arranged between the positioning rod 501 and an end portion of the bed frame 1; the pulling-assisted assembly 6 includes a first spring seat 601, a second spring seat 602, and a pull spring 603; the first spring seat 601 is fixedly mounted at the end portion of the bed frame 1; the second spring seat 602 is fixedly mounted on the positioning rod 501; and the pull spring 603 is mounted on the second spring seat 602 and the first spring seat 601. Under the action of the pull spring 603, the movable bed boards 3 can be successfully reset and lie flatly.

In summary, the manually adjustable bed provided in this embodiment has the following advantages:

When the angle adjustment mechanisms 5 are used, the movable bed boards 3 are lifted to clamp the cylindrical pins 5072 into the angle adjustment clamping slots 505, so that the cylindrical pins 5072 can be clamped into different angle adjustment clamping slots 505 according to a need. A difference between the angle adjustment mechanisms 5 designed in the present disclosure and an adjustment mechanism in the prior art is that:

When the movable bed boards 3 continue to be lifted after being lifted to the highest positions, the cylindrical pins 5072 can enter a space between the upper parts of the middle baffle plates 504 and the tops of the inner frames of the fixed frames 503 through the gaps close to the middle of the bed frame 1, and the movable bed boards 3 are then released. Under the action of the gravity of the movable bed boards 3, the cylindrical pins 5072 slide towards the gaps away from the middle of the bed frame 1 until the cylindrical pins fall into a space between the bottoms of the middle baffle plates 504 and the bottoms of the inner frames of the fixed frames 503 through the gaps. At this time, the movable bed boards 3 are in a horizontal state. The movable bed boards 3 are then lifted to clamp the cylindrical pins 5072 into the angle adjustment slots 505 to adjust the inclination angles of the movable bed boards 3 again. In the entire process of adjusting the inclination angles until the movable bed boards 3 are in the horizontal state, the cylindrical pins 5072 move counterclockwise along a trajectory of peripheral edges of the middle baffle plates 504 all the time. The operation method is new and interesting, and the operation experience can be greatly enhanced.

The above only describes the preferred embodiments of the present disclosure and does not limit the implementations and protection scope of the present disclosure. A person skilled in the art should realize that solutions obtained by equivalent replacements and obvious changes that are made according to the specification of the present disclosure and content shown shall all fall within the protection scope of the present disclosure.

What is claimed is:

1. A manually adjustable bed, comprising:

a bed frame (1), wherein a fixed bed board (2) is fixedly mounted at an upper part of the bed frame (1); a movable bed board (3) is hinged to each of two ends of the fixed bed board (2); a cross rod (301) is fixedly mounted on each movable bed board (3); and a group of angle adjustment mechanism (5) is mounted between respective ends of the cross rod (301) and the bed frame (1);

wherein each group of angle adjustment mechanism (5) comprises two fixed frames (503), two middle baffle plates (504), a positioning rod (501), and a connecting rod (502); the two fixed frames (503) are symmetrically and fixedly mounted on two sides of the bed frame (1); several angle adjustment clamping slots (505) are provided at bottoms of inner frames of the two fixed frames (503); the two middle baffle plates (504) are symmetrically and fixedly mounted on the two sides of the bed frame (1); the middle baffle plate (504) on the same side is located in the inner frame of the fixed frame (503) on the same side; gaps are reserved between two ends of the middle baffle plate (504) on the same side and the inner frame of the fixed frame (503) on the same side; elastically telescopic pins (507) are mounted at two ends of the positioning rod (501); the elastically telescopic pins (507) are clamped into the angle adjustment clamping slots (505) at the corresponding positions; the elastically telescopic pins (507) pass through the gaps; one end of the connecting rod (502) is fixedly connected to the positioning rod (501); and the other end of the connecting rod (502) is hinged to the cross rod (301).

2. The manually adjustable bed according to claim 1, wherein each elastically telescopic pin (507) comprises a sealing cap (5071), a resisting seat (5074), a reset spring (5073), and a cylindrical pin (5072); the sealing cap (5071) is fixedly mounted at an end portion of the positioning rod (501); a guide hole (5075) is centrally formed in the sealing cap (5071); the resisting seat (5074) is fixedly mounted in the end portion of the positioning rod (501); the reset spring (5073) resists between the resisting seat (5074) and the cylindrical pin (5072); the reset spring (5073) is located in the end portion of the positioning rod (501); one end of the cylindrical pin (5072) extends out of the sealing cap (5071) through the guide hole (5075) under the action of the reset spring (5073); and the cylindrical pin (5072) is clamped into the adjustment clamping slot (505).

3. The manually adjustable bed according to claim 2, wherein guide blocks (506) are fixedly mounted on two sides of the upper part of the bed frame (1) and on outer sides of the fixed frames (503); and when ends of the cylindrical pins (5072) extending out of the sealing caps (5071) resist against the guide blocks (506), the cylindrical pins fully retract into the guide holes (5075).

4. The manually adjustable bed according to claim 1, wherein each group of angle adjustment mechanism (5) comprises two connecting rods (502); and the two connecting rods (502) are symmetrically arranged between the cross rod (301) and the positioning rod (501).

5. The manually adjustable bed according to claim 1, wherein a pulling-assisted assembly (6) is arranged between the positioning rod (501) and an end portion of the bed frame (1); the pulling-assisted assembly (6) comprises a first spring seat (601), a second spring seat (602), and a pull spring (603); the first spring seat (601) is fixedly mounted at the end portion of the bed frame (1); the second spring seat (602) is fixedly mounted on the positioning rod (501); and the pull spring (603) is mounted on the second spring seat (602) and the first spring seat (601).

6. The manually adjustable bed according to claim 1, wherein supporting legs (4) are fixedly mounted at a bottom of the bed frame (1).

7. The manually adjustable bed according to claim 1, wherein a handle (302) is fixedly mounted at an upper part of one end of each of the movable bed boards (3) away from the fixed bed board (2).

* * * * *